US005148615A

United States Patent [19]

Maitlen et al.

[11] Patent Number: 5,148,615

[45] Date of Patent: Sep. 22, 1992

[54] DREDGING APPARATUS

[75] Inventors: C. Gene Maitlen; Randall E. Maitlen, both of Cushing, Okla.

[73] Assignee: VMI Inc., Cushing, Okla.

[21] Appl. No.: 710,262

[22] Filed: Jun. 4, 1991

[51] Int. Cl.[5] ..... E02F 3/24; E02F 3/92

[52] U.S. Cl. ..... 37/64; 37/66

[58] Field of Search ..... 37/8, 58, 64, 65, 66, 37/67, 68, 77, 238, 239

[56] References Cited

U.S. PATENT DOCUMENTS

| | | | |
|---|---|---|---|
| 3,521,387 | 7/1970 | Degelman | 37/66 |
| 3,738,029 | 6/1973 | Harmon | 37/66 |
| 4,102,064 | 7/1978 | Pot | 37/72 X |
| 4,776,112 | 10/1988 | Urbani | 37/58 |
| 4,819,346 | 4/1989 | Maitlen | 37/66 |
| 4,942,682 | 7/1990 | McDowell | 37/66 |
| 5,060,404 | 10/1991 | Lipford | 37/64 |

FOREIGN PATENT DOCUMENTS

| | | | |
|---|---|---|---|
| 197258 | 10/1986 | European Pat. Off. | 37/238 |
| 275812 | 11/1989 | Japan | 37/64 |
| 7703482 | 10/1978 | Netherlands | 37/67 |
| 216537 | 7/1968 | U.S.S.R. | 37/66 |
| 238419 | 7/1969 | U.S.S.R. | 37/67 |

*Primary Examiner*—Dennis L. Taylor
*Assistant Examiner*—Arlen L. Olsen
*Attorney, Agent, or Firm*—Dunlap, Codding & Lee

[57] ABSTRACT

An improvement in a dredging apparatus for cooperating in removing a mixture of liquids and solids from a selected site. The dredging apparatus includes a frame with means for moving the frame and an arm assembly having one end movably connected to the frame. The improvement includes an auger housing having an auger opening formed through a portion thereof. The auger housing is connected to the end of the arm assembly. An auger is rotatingly supported in the auger housing. A pump is disposed near the auger housing and positioned so that a pump inlet opening is fluidic communication with the auger opening. The mixture enters the auger opening and is augeringly moved toward the inlet opening in the pump. The pump pumps the mixture from the auger opening through a discharge opening of the pump.

9 Claims, 6 Drawing Sheets

DREDGING APPARATUS

FIELD OF THE INVENTION

The present invention relates to an improvement in a dredging apparatus comprising auger means mounted on the dredging apparatus for moving a mixture toward an inlet opening of a pump, the pump pumping the mixture through a discharge opening of the pump.

BRIEF DESCRIPTION OF THE DRAWINGS

FIG. 6 is an exploded view the mounting of the pump portion of the auger assembly.

DESCRIPTION OF THE PREFERRED EMBODIMENTS

Figure 1:
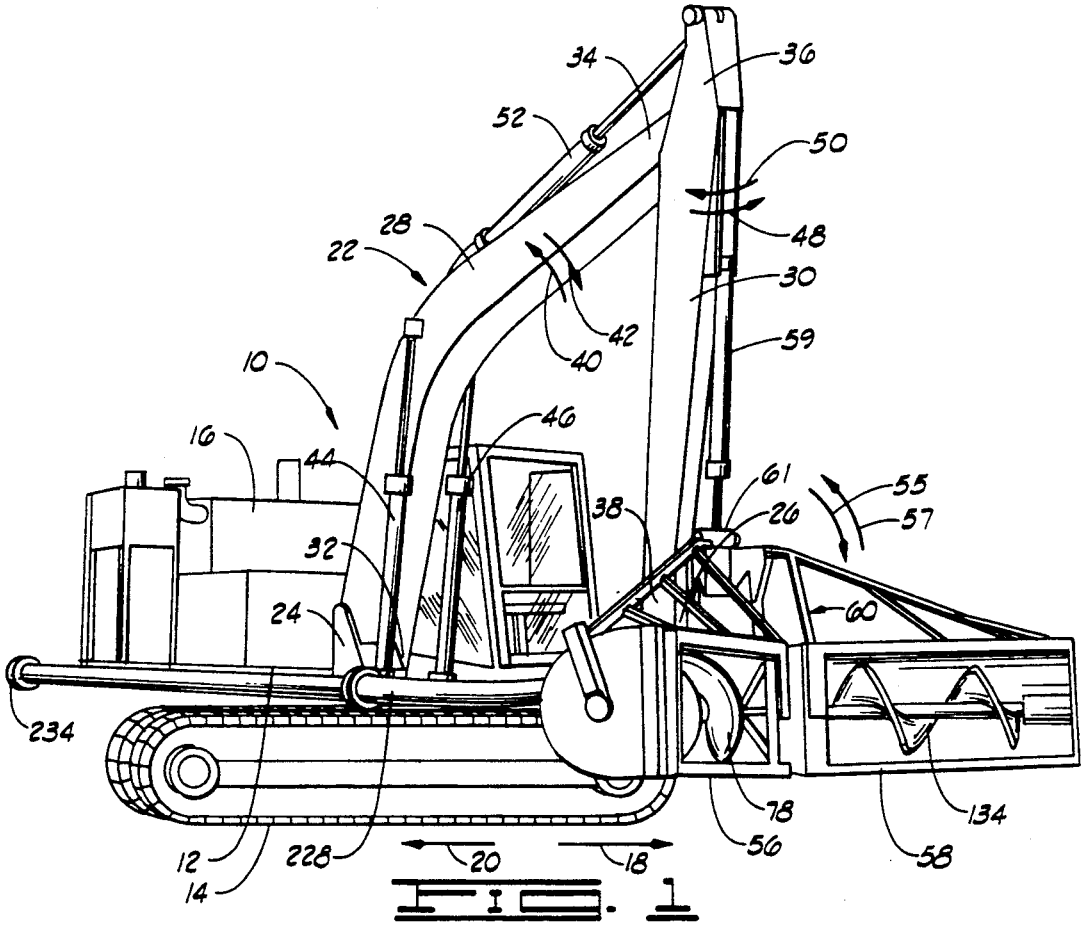
FIG. 1 is a side elevational view of a dredging apparatus incorporating the improvement of the present invention comprising an auger assembly.

Shown in FIG. 1 and designated therein by the general reference numeral 10 is a dredging apparatus constructed in accordance with the present invention. The dredging apparatus 10 is used for removing a mixture of liquids and solids from a selected site.

The dredging apparatus 10 includes a frame 12. A pair of tracks 14 are rotatingly supported on the frame 12 with each track 14 being disposed generally on one side of the frame 12, only one track 14 being shown in FIG. 1. An engine 16 is supported on the frame 12. The engine 16 is connected to the tracks 14 for rotatingly moving the tracks 14 for drivingly moving the frame 12 in a forward direction 18 or a rearward direction 20. An arm assembly 22 is movably connected to the frame 12. The arm assembly 22 more particularly includes the first end 24 and a second end 26. The first end 24 of the arm assembly 22 is movably connected to the frame 12. The arm assembly 22 comprises a first arm 28 and a second arm 30. The first arm 28 has a first end 32 and a second end 34. The first end 32 is movably or pivotally connected to the frame 12. The second arm 30 has a first end 36 and a second end 38. The first end 36 of the second arm 30 is movably or pivotally connected to the second end 34 of the first arm 28. The first end 32 of the first arm 28 forms the first end 24 of the arm assembly 22 and the second end 38 of the second arm 30 forms the second end 26 of the arm assembly 22. The first arm 28 is pivotally movable with respect to the frame 12 in a first direction 40 and an opposite direction 42 via hydraulic cylinders 44 and 46. The second arm 30 is movable in a first direction 48 and in an opposite second direction 50 relative to the second end 34 of the first arm 28 via a hydraulic cylinder 52. The equipment just described in this paragraph is old in the art. In fact, the present invention was constructed by purchasing a caterpillar excavator model 231D which basically is constructed and built in the manner just described in this paragraph and placing a different engine and controls on this excavator for operation as a dredging apparatus, this excavator also being modified by removing the existing counterweight and adding a fuel tank.

The improvement of the present invention comprises basically consists of an auger assembly 54 movably connected to the second end 38 of the second arm 30 for pivotal movement in a first direction 55 and in a second direction 57.

One end of a hydraulic cylinder 59 is pivotally connected to the auger assembly 54 at 61 and the opposite end of the hydraulic cylinder 59 is pivotally connected to the second arm 30. The hydraulic cylinder 59 functions to move the auger assembly 54 in the direction 55 or 57 during the operation of the dredging apparatus 10.

Figure 2:
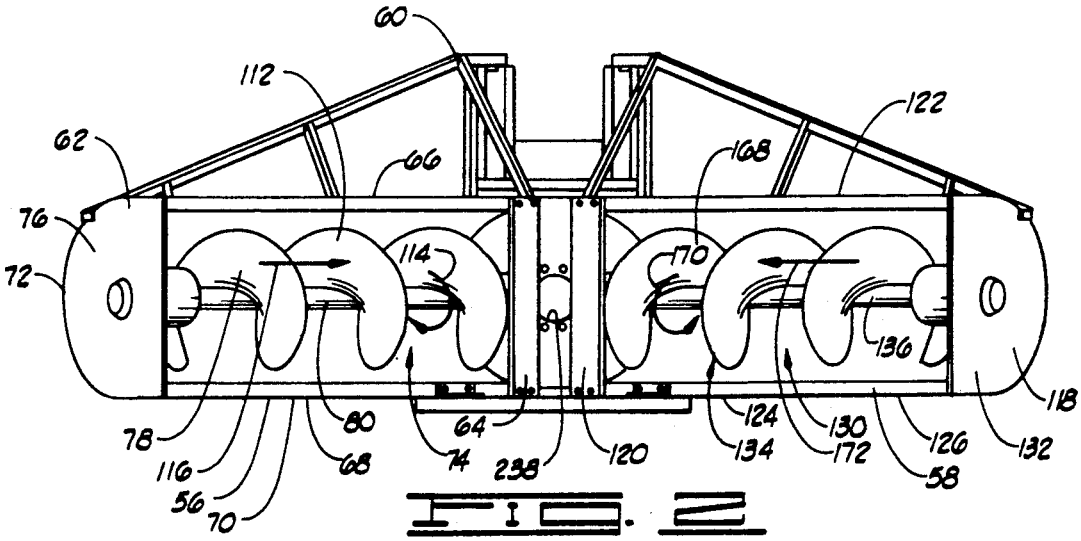
FIG. 2 is a front elevational view of the auger assembly of FIG. 1, but not showing the pump mounted thereon, the pump mounting being shown in FIG. 6.
Figure 3:
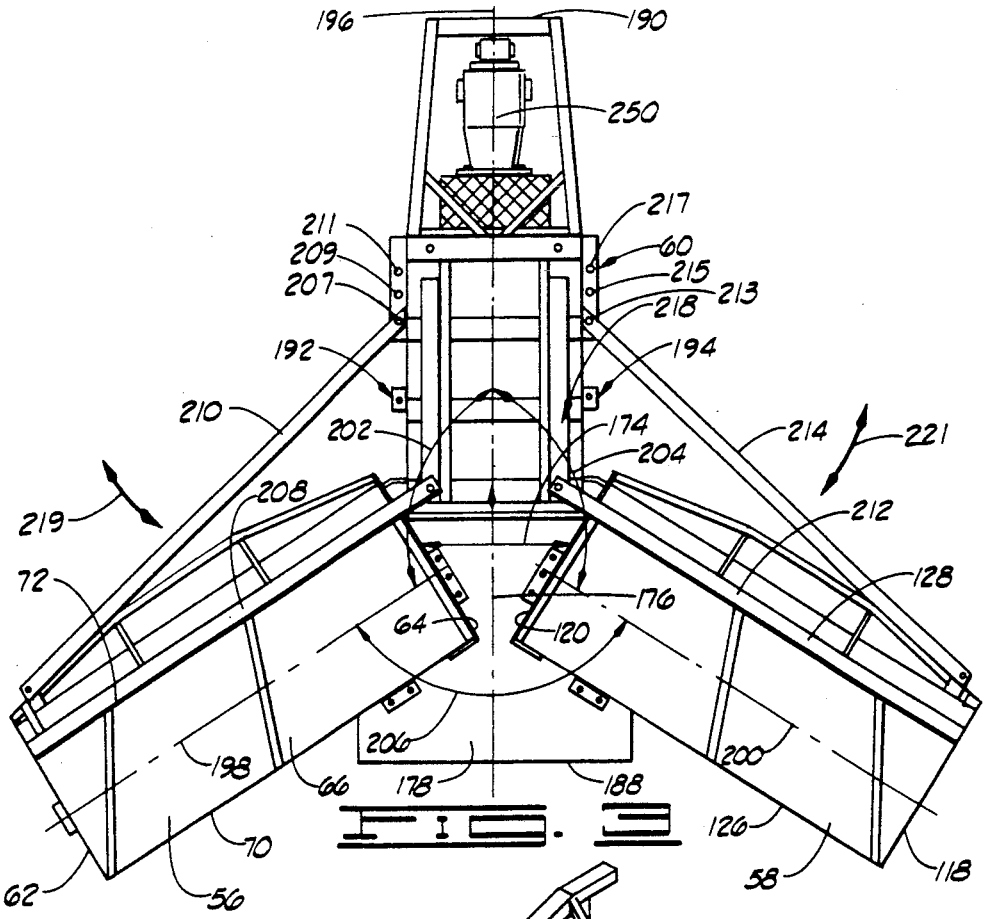
FIG. 3 is a top elevational view of the auger assembly of FIG. 2.

The auger assembly 54 comprises a first auger housing 56 (FIGS. 1, 2, 3 and 4) and a second auger housing 58 (FIGS. 1, 2, 3 and 5) connected to an auger frame 60 (FIGS. 1, 2 and 3).

Figure 4:
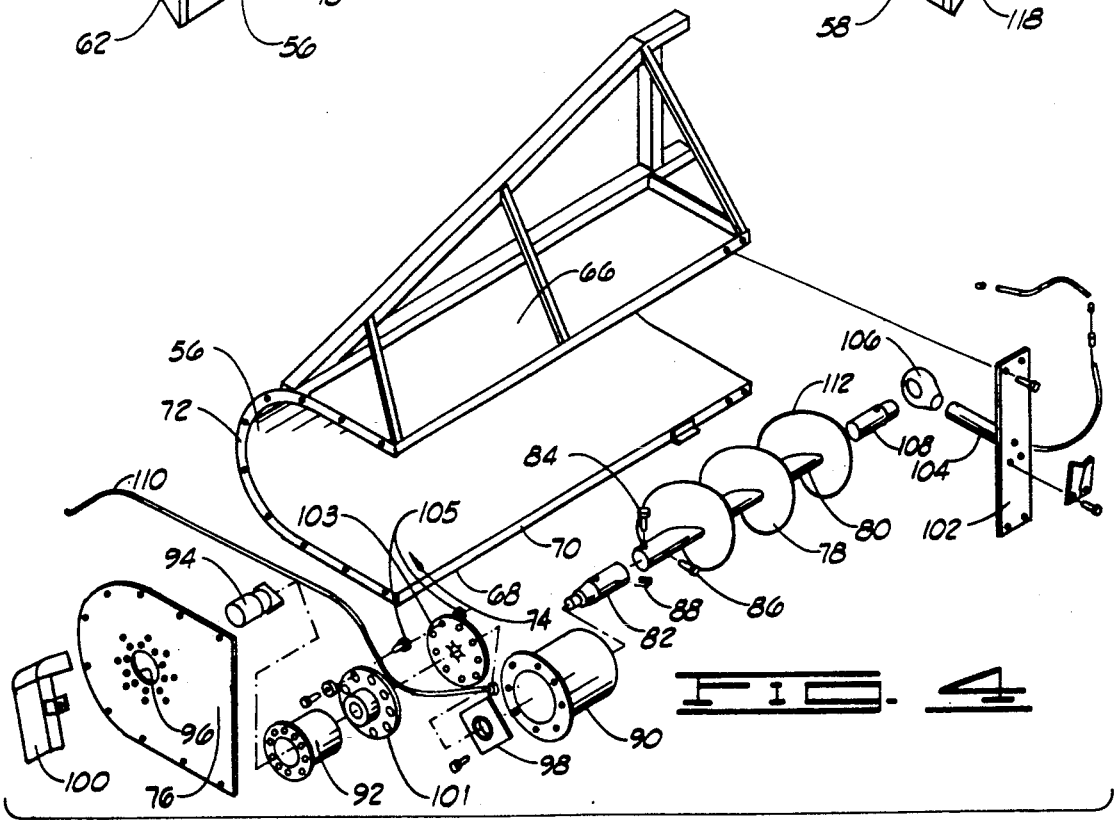
FIG. 4 is an exploded view of the right auger portion of the auger assembly of FIGS. 2 and 3.

As shown in FIGS. 2, 3 and 4), the first auger housing 56 has a first end 62, a second end 64, a top side 66, a bottom side 68, a front 70 and a back 72. An auger opening 74 (FIGS. 2 and 4) is formed through the front 70 and the auger opening 74 extends from the first end 62 to the second end 64 of the first auger housing 56. The first auger housing 56 more particularly comprises a single sheet of metal bent in a U-shape to form the first auger housing 56 as just described and as shown more clearly in FIG. 4.

An end plate 76 (FIGS. 2 and 4) is connected to the first end 62 of the first auger housing 56 thereby closing the auger opening 74 generally at the first end 62 of the first auger housing 56.

A first auger 78 (FIGS. 1, 2 and 4) is rotatingly supported on the first auger housing 56 with at least a portion of the first auger 78 being disposed in the auger opening 74. More particularly, the first auger 78 is disposed within the auger opening 74 and at least partially surrounded by the auger frame 60.

The first auger 78 includes a hollow auger shaft 80 (FIGS. 2 and 4). One end of a female shaft 82 (FIG. 4) is disposed in the hollow opening at one end of the auger shaft 80 and secured therein via bolts and nuts with the bolts being designated in FIG. 4 by the reference numerals 84 and 86 and one of the nuts being shown in FIG. 4 and designated therein by the reference numeral 88.

The female shaft 82 is disposed in an opening of a thimble 90 (FIG. 4) and one end of the thimble 90 is secured to the end plate 76. Another thimble 92 (FIG. 4) also is disposed in the opening in the thimble 90. The thimble 92 also is secured to the end plate 76.

A hydraulic motor 94 (FIG. 4) is disposed in the opening in the thimble 92. One end of the hydraulic motor 94 is disposed in an opening 96 (FIG. 4) in the end plate 76. A bearing 98 (FIG. 4) is secured in the opening in the thimble 90. One end of the female shaft 82 is bearingly disposed in the bearing 98. The hydraulic motor 94 is connected to the female shaft 82 and rotatingly drives the female shaft 82 in a driven condition of the hydraulic motor 94. A guard 100 (FIG. 4) is connected to the end plate 76 and disposed generally over the hydraulic motor 94.

As shown in FIG. 4, shock absorbing rubber grommets are interposed between the thimbles 90 and 92 for absorbing axial shocks. The rubber grommets comprise a hub 101 and a plate 103 with a plurality of rubber grommets or rubber shocks 105 connected thereto, as shown in FIG. 4. Such rubber grommets are disclosed and described in detail in U.S. Pat. No. 4,819,346, titled "Dredging Cutting Head With Shock Absorber", issued Apr. 11, 1989, which disclosure specifically is incorporated herein by reference.

A bearing mount 102 (FIG. 4) is connected to the auger housing 56 and disposed generally at the second end 64 of the auger housing 56. One end of a rod 104 is secured to the bearing mount 102 and a bearing 106 is secured to the opposite end of the rod 104. One end of a male shaft 108 is connected to one end of the auger shaft 80 and the opposite end of the male shaft 108 is bearingly disposed through the bearing 106.

One end of a grease hose 110 (FIG. 4) is connected to the bearing 98. The opposite end of the grease hose 110 is connected to and disposed through the end plate 76 so that grease may be applied to the bearing 98 from a position outside the end plates 76.

Thus, when the hydraulic motor 94 is rotatingly driven, the hydraulic motor 94 functions to rotatingly drive the first auger 78 which is rotatingly supported in the first auger housing 56 via the bearings 98 and 106. The first auger 78 includes an auger flight 112 (FIGS. 2 and 4) which is positioned on the auger shaft 80 so that, when the first auger 78 is rotatingly driven in a direction 114 (FIG. 2), the auger flight 112 functions to move mixture within the auger opening 74 in a direction 116 (FIG. 2) generally from the first end 62 of the first auger housing 56 toward the second end 64 of the first auger housing 56.

Figure 5:
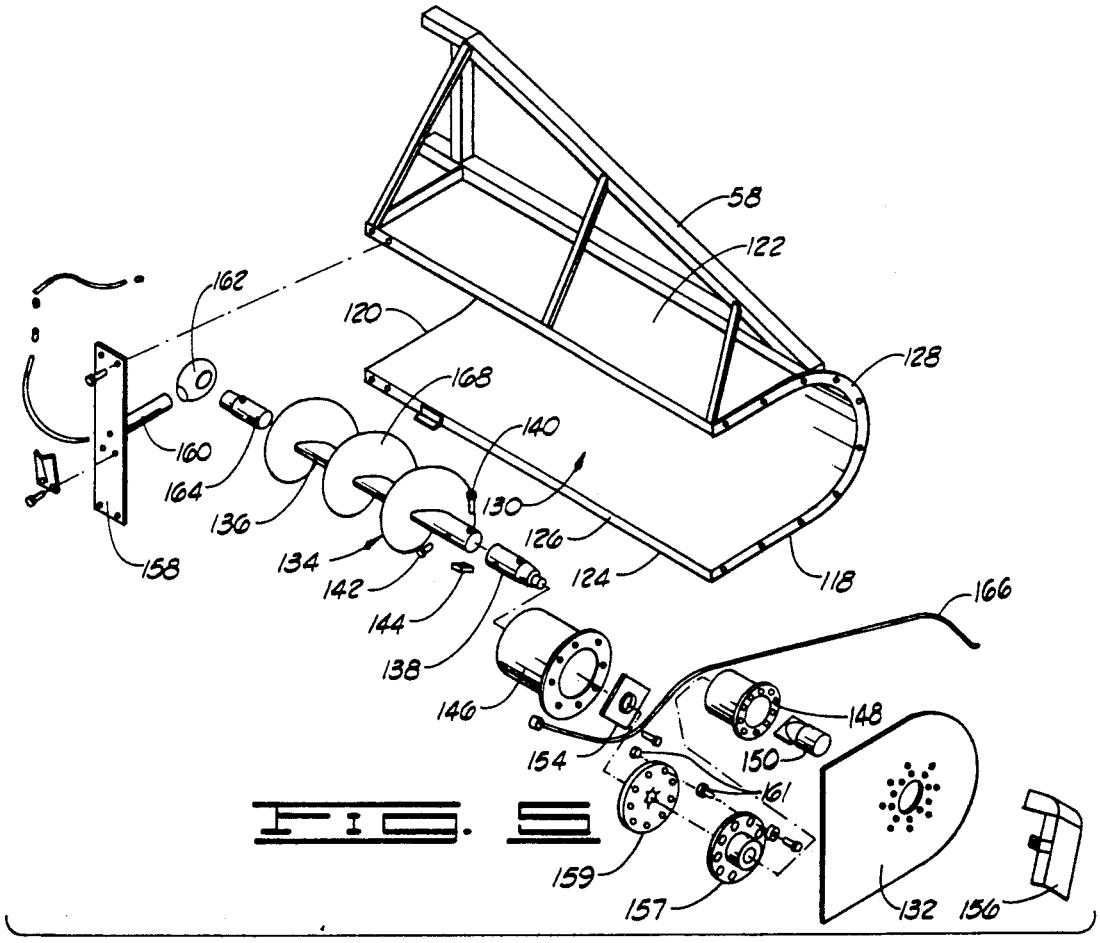
FIG. 5 is an exploded view of a left auger of the auger assembly of FIGS. 2 and 3.

As shown in FIGS. 2 and 5, the second auger housing 58 has a first end 118, a second end 120, a top side 122, a bottom side 124, a front 126 and a back 128 An auger opening 130 is formed through the front 126 and the auger opening 130 extends from the first end 118 to the second end 120 of the second auger housing 58. The second auger housing 58 more particularly comprises a single sheet of metal bent in a U-shape to form the second auger housing 58 as just described and as shown more clearly in FIG. 5.

An end plate 132 (FIGS. 2 and 5) is connected to the first end 118 of the second auger housing 58 thereby closing the auger opening 130 generally at the first end 118 of the second auger housing 58.

An auger 134 (FIGS. 2 and 5) is rotatingly supported on the second auger housing 58 with at least a portion of the auger 134 being disposed in the auger opening 130. More particularly, the auger 134 is disposed within the auger opening 130 and at least partially surrounded by the auger frame 60.

As shown in FIGS. 5, the auger 134 includes a hollow auger shaft 136. One end of a female shaft 138 is disposed in the hollow opening at one end of the auger shaft 136 in secured therein via bolts and nuts with the bolts being designated in FIG. 5 by the reference numerals 140 and 142 and one of the nuts being shown in FIG. 5 and designated therein by the reference numeral 144 The female shaft 130 is disposed in an opening of a thimble 146 and one end of the thimble 146 is secured to the end plate 132. Another thimble 148 also is disposed in the opening in the thimble 146 and the thimble 148 also is secured to the end plate 132. A hydraulic motor 150 is disposed in the opening in the thimble 148 and one end of the hydraulic motor 150 is disposed in an opening 152 in the end plate 132. A bearing 154 is secured in the opening in the thimble 146 and one end of the female shaft 138 is bearingly disposed in the bearing 154. The hydraulic motor 150 is connected to the female shaft 138 and rotatingly drives the female shaft 138 in a driven condition of the hydraulic motor 150. A guard 156 is connected to the end plate 132 and disposed generally over the hydraulic motor 150.

As shown in FIG. 5, shock absorbing rubber grommets are interposed between the thimbles 146 and 148 for absorbing axial shocks. The rubber grommets comprise a hub 157 and a plate 159 with a plurality of rubber grommets or rubber shocks 161 connected thereto, as shown in FIG. 5. Such rubber grommets are disclosed and described in detail in U.S. Pat. No. 4,819,346, titled "Dredging Cutting Head With Shock Absorber", issued Apr. 11, 1989, which disclosure specifically is incorporated herein by reference.

As shown in FIG. 5, a bearing mount 158 is connected to the auger housing 58 and disposed generally at the second end 120 of the auger housing 8. One end of a rod 160 is secured to the bearing mount 158 and a bearing 162 is secured to the opposite end of the rod 160. One end of a male shaft 64 is connected to one end of the auger shaft 136 and the opposite end of the male shaft 164 is bearingly disposed through the bearing 162.

One end of a grease hose 166 (FIG. 5) is connected to the bearing 154. The opposite end of the grease hose 166 is connected to and disposed through the end plate 132 so that grease may be applied to the bearing 154 from a position outside the end plates 132.

Thus, when the hydraulic motor 150 is rotatingly driven, the hydraulic motor 150 functions to rotatingly drive the auger 134 which is rotatingly supported in the second auger housing 58 via the bearings 154 and 162. The auger 134 includes an auger flight 168 (FIGS. 2 and 5) which is positioned on the auger shaft 136 so that, when the auger 134 is rotatingly driven in a direction 170 (FIG. 2), the auger flight 168 functions to move mixture within the auger opening 130 in a direction 172 (FIG. 2) generally from the first end 118 of the second auger housing 58 toward the second end 120 of the second auger housing 58.

The second end 64 of the first auger housing 56 is spaced a distance 174 (FIG. 3) from the second end 120 of the second auger housing 58 forming a flow passageway 176 (FIG. 3) between the first and the second auger housings 56 and 58. The auger opening 74 extends through the first auger housing 56 and intersects the second end 64. The auger opening 130 extends through the second auger housing 58 and intersects the second end 120.

The auger frame 60 includes a plate 178 (FIG. 3). The first auger housing 56 is connected to the plate 178 generally near the second end 64 of the first auger housing 56. The second auger housing 58 generally near the second end 120 thereof is connected to the plate 178.

As shown in FIG. 3, the auger frame 60 has a front end 188, a rear end 190, a left side 192 and a right side 194. The first and the second auger housings 56 and 58 are connected to the auger frame 60 generally near the front end 188 of the auger frame 60. The auger frame 60 has a auger frame axis 196 extending generally between the front end 188 and the rear end 190 thereof. The first auger housing 56 has a first auger axis 198 defined generally via a center line extending through the auger shaft 80. The second auger housing 58 has a second auger axis 200 defined via a center line extending through the auger shaft 136.

As shown in FIG. 3, the first auger housing extends a distance from the left side 192 of the auger frame 60 at an angle 202 with respect to the auger frame axis 196, the second auger housing 58 extends a distance from the right side 194 of the auger frame 90 at an angle 204. The first auger housing 56 extends at an angle 206 with respect to the second auger housing 58. The first and the second auger housings 56 and 58 are angled toward the flow passageway 176 thereby facilitating the flow of material through the first and the second auger housings 56 and 58 and into the flow passageway 76 during the operation of the dredging apparatus 10.

As shown in FIG. 3, the first auger housing 56 also is connected the auger frame 60 via reinforcing bars 208 and 210. The second auger housing 58 also is connected to the auger frame 60 via reinforcing bars 212 and 214.

The bar 210 is shown in FIG. 3 as being connected to the auger frame 60 via a bolt 207 which extends through an opening (not shown) in the auger frame 60. There are two other openings 209 and 211 in the auger frame 60.

The bar 214 is shown in FIG. 3 as being connected to the auger frame 60 via a bolt 213 which extends through an opening (not shown) in the auger frame 60. There are two other openings 215 and 217 in the auger frame 60.

By connecting the bar 210 to any one of the three openings including the two openings 209 and 211 and by connecting the bar 214 to any one of the three openings including the two openings 215 and 217, the first auger housing 56 may be moved in directions 219 and the second auger housing 58 may be moved in directions 221 to move the auger housings 56 and 58 generally toward each other or generally away from each other thereby varying the angle 206 between the auger housings 56 and 58.

As shown in FIGS. 3 and 6, the auger frame 60 includes a pump base 218. A pump 220 (FIG. 6) is mounted on the pump base 218 via a bracket 224. The pump 220 has an inlet opening 224 and a discharge opening (not shown) intersecting a pump discharge conduit 226.

One end of a mixture discharge conduit 228 (FIGS. 1 and 6) is connected to the pump discharge conduit 226 via a discharge pipe 230 (FIG. 6). The mixture discharge conduit 228 extends from the pump 220 a distance along the right side of the frame 12 with the mixture discharge conduit 228 being connected to and supported on the right side of the frame 12. The mixture discharge conduit 228 has a discharge end 234 (FIG. 1). The mixture discharge conduit 228 has an opening (not shown) extending therethrough and intersecting the opposite ends thereof including the discharge end 234. A pump front plate 236 (FIG. 6) is connected to the pump 220. The pump front plate 236 has an opening 238 (FIG. 2 and 6) formed through a central portion thereof. The opening 238 is aligned with the inlet opening 224 of the pump 220. The inlet opening 224 of the pump 220 is positioned between the first and the second auger housings 56 and 58 and positioned in the flow passageway 176 formed between the first and the second auger housings 56 and 58. The pump 220 is in fluidic communication with the auger openings 74 and 130.

A hydraulic motor 250 (FIG. 3) is connected to the pump 220 for driving the pump 220.

Figure 7:
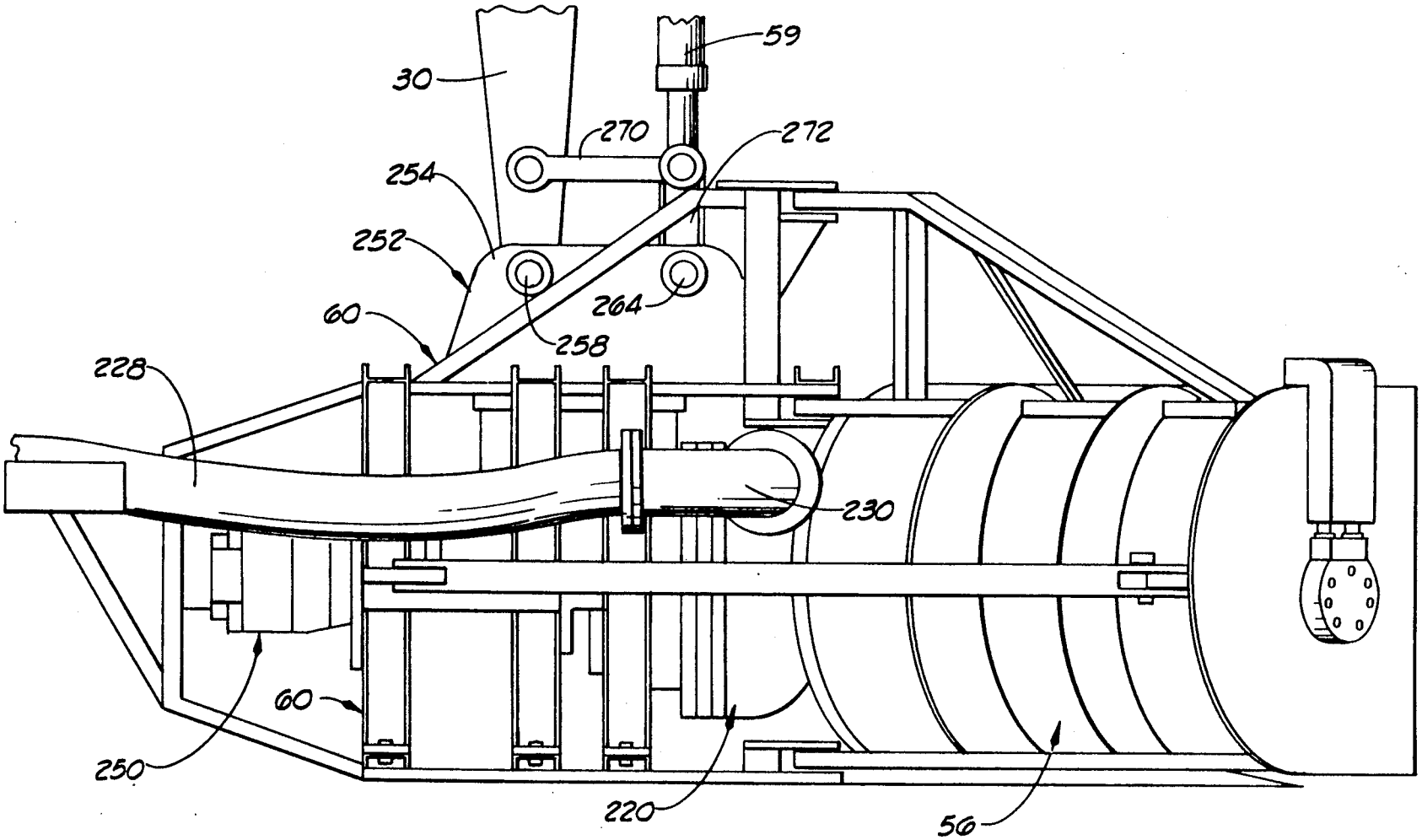
FIG. 7 is a side elevational view showing the auger frame and a portion of the first auger housing and showing the connection between the second arm, the hydraulic cylinder and the auger frame.
Figure 8:
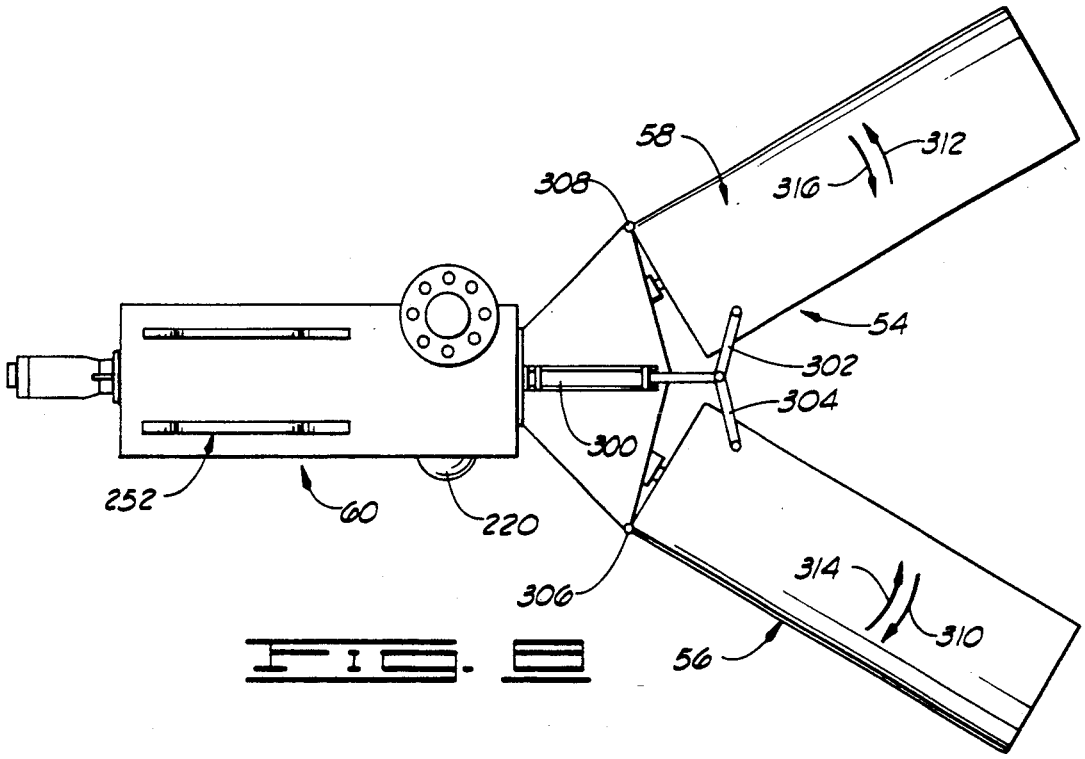

The auger frame 60 includes a mounting frame 252 (FIGS. 6 and 7). The mounting frame 252 includes a pair of plate supports 254 and 256. The second arm 30 is disposed between the plates 254 and 256 and pivotally connected to the plates 254 and 256 via a pivot pin 258 (FIG. 7) which extends through openings 206 and 262 (FIG. 6) in the plates 254 and 256, respectively. The rod of the hydraulic cylinder 59 is disposed between the plates 254 and 256 and pivotally connected to the plates 254 and 256 via a pivot pin 264 (FIG. 7) which extends through openings 266 and 268 (FIG. 6) in the plates 254 and 256, respectively.

The second arm 30 is pivotally connected to the rod of the hydraulic cylinder 59 via a link 270 (FIG. 7). One end of the link 270 is pivotally connected to the second arm 30 and the opposite end of the link 270 is pivotally connected to the rod of the hydraulic cylinder 59. More particularly, a brace 272 is pivotally connected between the rod of the hydraulic cylinder 59 and the plates 254 and 256.

In operation, the arms 28 and 30 are moved in the respective directions 40 and 50 to lift the auger housing 60 a distance above the earth. In this position, the dredging apparatus 10 can be moved to a selected site.

At a selected site, the arms 32 and 34 are pivotally moved in the respective directions 42 and 48 to position the augers 78 and 134 generally within the mixture to be dredged or removed. The hydraulic motors 94 and 150 each are actuated to drivingly rotate the respective augers 78 and 134. The hydraulic motor 250 is actuated to drive the pump 220. The hydraulic cylinder 59 is actuated to move the auger housing 60 in the direction 55 or 57 to position the auger housings 56 and 58 in a generally horizontal plane with respect to the surface being dredged at the site. In this position, the mixture is moved into the auger openings 74 and 130 as the dredging apparatus 10 is moved in the forward direction 18. The augers 78 and 134 move the mixture in the directions 116 and 172 respectively generally toward the flow passageway 176. The mixture moves through the respective auger housings 56 and 58 to a position wherein the mixture exits the respective exit ends 64 and 120 of the auger housings 56 and 58 and flows into the flow passageway 176. The mixture flows through the flow passageway 176 and into the inlet opening 224 of the pump 220. The pump 220 operates to pump the mixture received from the auger housings 56 and 58 with the mixture being discharged through the mixture discharge conduit 228.

Figure 8:
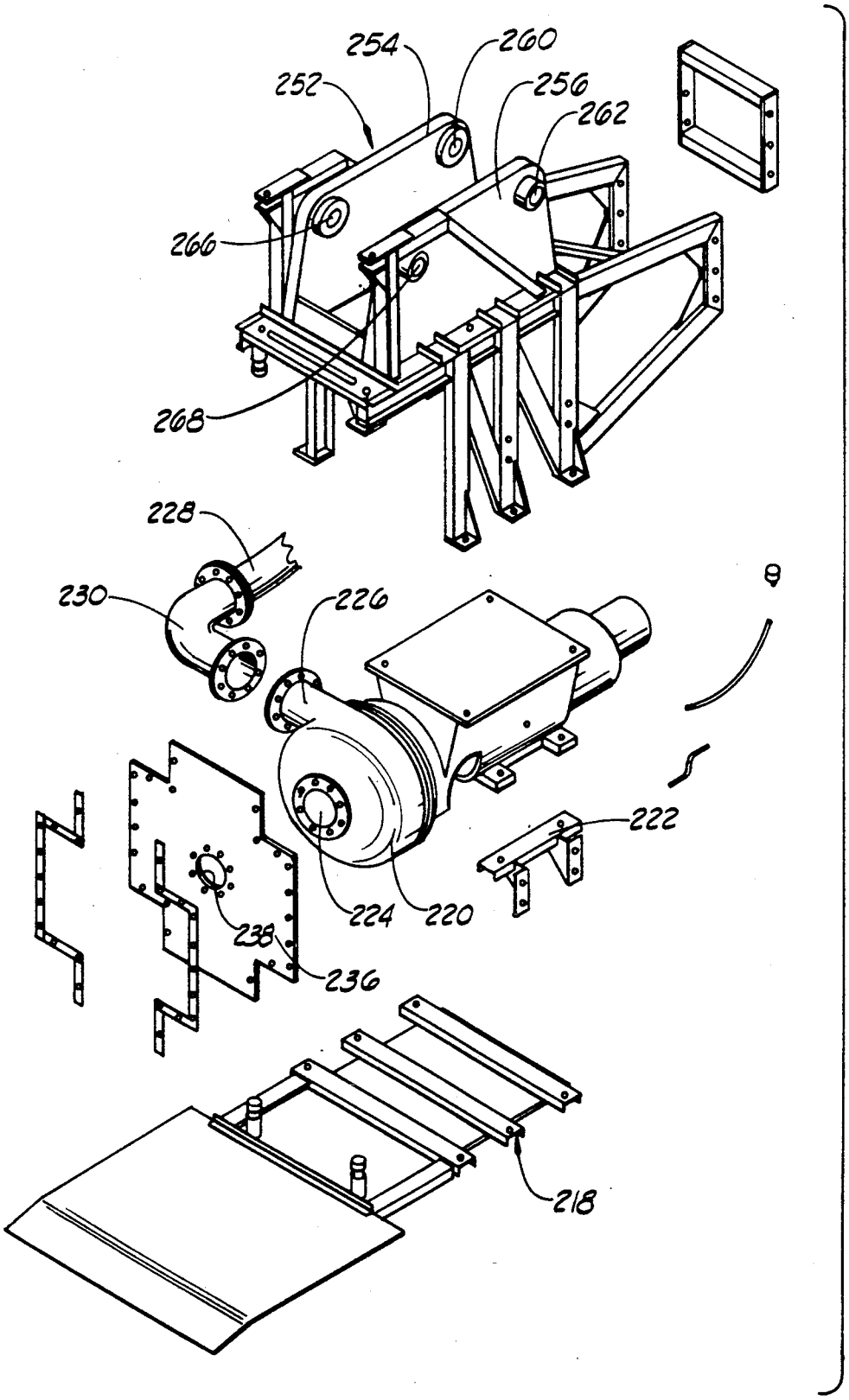
FIG. 8 is a top elevational view similar to FIG. 3, but showing a modified connection between the auger assembly and the auger frame.
Figure 9:
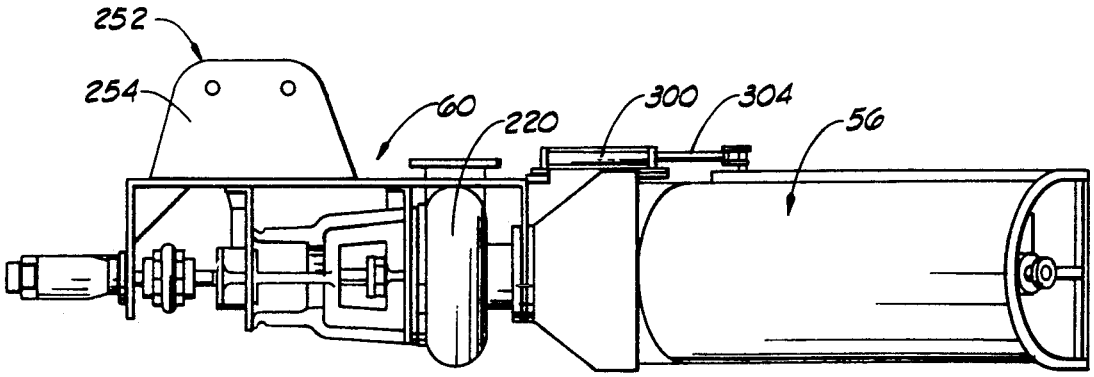
FIG. 9 is a side elevational view of the modified connection between the auger assembly and the auger frame shown in FIG. 8.

Shown in FIGS. 8 and 9 is the auger assembly 54 connected to the auger frame 60 in a modified manner. More particularly, one end of a hydraulic cylinder 300 is connected to the auger frame 60 and the hydraulic cylinder 300 extends a distance from the auger frame 60. The rod of the hydraulic cylinder 300 is pivotally connected to one end of a link 302 and the opposite end of the link 302 is pivotally connected to the second auger housing 58. One end of the rod of the hydraulic cylinder 300 also is pivotally connected to a link 304 and the opposite end of the link 304 is pivotally connected to the first auger housing 56. The first auger housing 56 is pivotally connected to the auger frame 60 at a pivot connection 306 and the second auger housing 58 is pivotally connected to the auger frame 60 via a pivot connection 308.

In operation, as the hydraulic cylinder 300 is actuated to move the cylinder rod in an outwardly direction, the first and the second auger housings 56 and 58 each are moved in the respective directions 310 and 312 thereby moving the first auger housing 56 in a direction generally away from the second auger housing 58 and moving the second auger housing 58 in a direction generally away from the first auger housing 56. By the same token, when the rod of the hydraulic cylinder 300 is moved inwardly, the first and the second auger housings 56 and 58 each are moved in the respective directions 314 and 316 thereby moving the first auger housing 56 in a direction generally toward the second auger housing 58 and moving the second auger housing 58 in a the direction 316 generally toward the first auger housing 56.

Also, as shown in FIGS. 8 and 9, the pump 220 discharge is angled upwardly, rather than out the side of the auger frame 60 which may be desired in some applications.

Changes may be made in the construction and the operation of the various components, elements and assemblies described herein without departing from the spirit and scope of the invention as defined in the following claims.

What is claimed is:

1. An improvement in a dredging apparatus for cooperating in removing a mixture of liquids and solids from a selected site comprising a frame with means for moving the frame in a forward direction and a rearward direction, and an arm assembly having a first end and a second end with the first end of the arm assembly being movably connected to the frame, the improvement comprising:

auger housing means connected to the arm assembly and having an auger opening formed through a portion thereof, the auger housing means comprising:

a first auger housing having a first end, a second end, a front and a back, an auger opening being formed through the front of the first auger housing and the auger opening intersecting the second end of the first auger housing, the first auger housing being connected to the auger frame; and a second auger housing having a first end, a second end, a front and a back, an auger opening being formed through the front of the second auger housing and the auger opening extending through the second auger housing intersecting the second end thereof, the second auger housing being connected to the auger frame, and the second end of the second auger housing being disposed near and spaced a distance from the second end of the first auger housing forming a flow passageway therebetween, the first auger housing is disposed at an angle with respect to the second auger housing with the first and the second auger housings each being angled inwardly toward the flow passageway at an angle less than about 180 degrees; and auger means rotatingly supported on the auger housing means and at least a portion of the auger means being disposed in the auger opening in the auger housing means;

means for rotatingly driving the auger means; and pump means having an inlet opening and an outlet opening, the inlet opening being in fluidic communication with the auger opening in the auger housing means, the mixture entering the auger opening and the auger means moving the mixture toward the pump means when the pump is drivingly rotated and the pump means receiving the mixture passed from the auger housing means via the inlet opening of the pump means and the pump means pumping the mixture through the discharge opening of the pump means.

2. The improvement of claim 1 wherein the arm assembly comprises a first arm having a first end and a second end with the first end of the first arm forming the first end of the arm assembly and the first end of the first arm being movably connected to the frame for movement in a first and a second direction, and a second arm having first end and a second end with the first end of the second arm being movably connected to the second end of the first arm and the second end of the second arm forming the second end of the arm assembly, and means for moving the first arm in a first direction and in an opposite second direction, and means for moving the second arm in a first direction and in an opposite second direction, the auger housing means being connected to the second arm.

3. The improvement of claim 2 wherein the auger housing means is pivotally connected to the second end of the second arm for pivotal movement in a first direction and in an opposite second direction, and wherein the improvement further comprises:

means for moving the auger housing means in the first direction and the second direction.

4. The improvement of claim 1 wherein the improvement further comprises:

discharge conduit means having one end connected to the discharge opening of the pump means for receiving the mixture pump from the pump means, a portion of the discharge conduit means being supported on the frame.

5. The improvement of claim 1 wherein the improvement further comprises:

an auger frame connected to the second end of the arm assembly, the auger housing means, auger means, means for rotatingly driving the auger means, and the pump means being mounted on the auger frame.

6. An improvement of claim 5 wherein the auger means further comprises:

a first auger rotatingly supported in the first auger housing with at least a portion of the first auger being disposed in the first auger opening in the first auger housing, the first auger being adapted to move the mixture in the auger opening in the first auger housing in a direction generally from the first end toward the second end of the first auger housing when drivingly rotated;

a second auger rotatingly supported in the second auger housing with at least a portion of the second auger being disposed in the auger opening in the second auger housing, the second auger being adapted to move the mixture in the auger opening in the second auger housing in a direction generally from the first end toward the second end of the second auger housing, the auger opening in the second auger housing intersecting the second end of the second auger housing; and wherein the means for rotatingly driving the auger means further comprises:

means for rotatingly driving the first auger, the first auger moving the mixture through the second end of the first auger housing and into the flow passageway when rotatingly driven; and means for rotatingly driving the second auger, the second auger moving the mixture through the second end of the second auger housing and into the flow passageway when rotatingly driven.

7. The improvement of claim 6 wherein the pump means is supported on the auger housing and positioned in the flow passageway with the inlet opening of the pump means being disposed between the second end of the first auger housing and the second end of the second auger housing.

8. The improvement of claim 7 wherein the auger frame is further defined as being movably connected to the second end of the arm assembly for pivotal movement in the first direction and in an opposite second direction;

means for moving the auger frame in the first and the second directions.

9. An improvement in a dredging apparatus for cooperating in removing a mixture of liquids and solids from a selected site comprising a frame with means for moving the frame in a forward direction and a rearward direction, and an arm assembly having a first end and a second end with the first end of the arm assembly being movably connected to the frame, the improvement comprising:

auger housing means connected to the arm assembly, and having an auger opening formed through a portion thereof, the auger housing means comprising:

a first auger housing having a first end, a second end, a front and a back, an auger opening being formed through the front of the first auger housing and the auger opening intersecting the second end of the first auger housing, the first auger housing being connected to the auger frame; and a second auger housing having a first end, a second end, a front and a back, an auger opening being formed through the front of the second auger housing and the auger opening extending through the second auger housing intersecting the second end thereof, the second auger housing being connected to the auger frame, and the second end of the second auger housing being disposed near and spaced a distance from the second end of the first auger housing forming a flow passageway therebetween the first auger housing is disposed at an angle with respect to the second auger housing with the first and the second auger housings each being angled inwardly toward the flow passageway at an angle less than about 180 degrees; and auger means rotatingly supported on the auger housing means and at least a portion of the auger means being disposed in the auger opening in the auger housing means;

a first auger rotatingly supported in the first auger housing with at least a portion of the first auger being disposed in the first auger opening in the first auger housing, the first auger being adapted to move the mixture in the auger opening in the first auger housing in a direction generally from the first end toward the second end of the first auger housing when drivingly rotated;

a second auger rotatingly supported in the second auger housing with at least a portion of the second auger being disposed in the auger opening in the second auger housing, the second auger being adapted to move the mixture in the auger opening in the second auger housing in a direction generally from the first end toward the second end of the second auger housing, the auger opening in the second auger housing intersecting the second end of the second auger housing; and means for rotatingly driving the auger means, comprising:

means for rotatingly driving the first auger, the first auger moving the mixture through the second end of the first auger housing and into the flow passageway when rotatingly driven; and means for rotatingly driving the second auger, the second auger moving the mixture through the second end of the second auger housing and into the flow passageway when rotatingly driven; and pump means having an inlet opening and an outlet opening, the inlet opening being in fluidic communication with the auger opening in the auger housing means, the mixture entering the auger opening and the auger means moving the mixture toward the pump means when the pump is drivingly rotated and the pump means receiving the mixture passed from the auger housing means via the inlet opening of the pump means and the pump means pumping the mixture through the discharge opening of the pump means;

an auger frame connected to the second end of the arm assembly, the auger housing means, auger means, means for rotatingly driving the auger means, and the pump means being mounted on the auger frame.

* * * * *

UNITED STATES PATENT AND TRADEMARK OFFICE

CERTIFICATE OF CORRECTION

PATENT NO. : 5,148,615

DATED : September 22, 1992

INVENTOR(S) : Maitlen, et al.

It is certified that error appears in the above-identified patent and that said Letters Patent is hereby corrected as shown below:

Column 3 line 41, please insert the character --.-- after the numeral 128.

Column 3 line 66, please insert the character --.-- after the numeral 144.

Column 4, line 25, please delete the numeral "8" and substitute therefore the numeral --58--.

Column 4, line 28, please delete the numeral "64" and substitute therefore the numeral --164--.

Column 9, line 16, please delete the word "the" and substitute therefore the word --a--.

Column 9, line 50, please delete the word "second" and substitute therefore the

UNITED STATES PATENT AND TRADEMARK OFFICE

CERTIFICATE OF CORRECTION

PATENT NO. : 5,148,615
DATED : September 22, 1992
INVENTOR(S) : Maitlen, et. al.

It is certified that error appears in the above-indentified patent and that said Letters Patent is hereby corrected as shown below:

word --first--.

Signed and Sealed this

Nineteenth Day of October, 1993

*Attest:*

Bruce Lehman

BRUCE LEHMAN

*Attesting Officer*

*Commissioner of Patents and Trademarks*